US012492632B2

(12) United States Patent
Machado De Azevedo Novaes et al.

(10) Patent No.: US 12,492,632 B2
(45) Date of Patent: Dec. 9, 2025

(54) METHOD FOR QUANTIFICATION OF LOSS OF INJECTIVITY ASSOCIATED WITH CORROSION PRODUCTS

(71) Applicant: Petróleo Brasileiro S.A.—Petrobras, Rio de Janeiro (BR)

(72) Inventors: Aline Machado De Azevedo Novaes, Rio de Janeiro (BR); Rafaella Magliano Balbi De Faria, Rio de Janeiro (BR)

(73) Assignee: Petróleo Brasileiro S.A.—Petrobras, Rio de Janeiro (BR)

( * ) Notice: Subject to any disclaimer, the term of this patent is extended or adjusted under 35 U.S.C. 154(b) by 525 days.

(21) Appl. No.: 17/975,684

(22) Filed: Oct. 28, 2022

(65) Prior Publication Data

US 2023/0132935 A1 May 4, 2023

(30) Foreign Application Priority Data

Oct. 28, 2021 (BR) ..... 10 2021 021656 5

(51) Int. Cl.
*E21B 49/08* (2006.01)

(52) U.S. Cl.
CPC ..... *E21B 49/0875* (2020.05); *E21B 49/088* (2013.01)

(58) Field of Classification Search
CPC ..... E21B 49/0875; E21B 49/088
See application file for complete search history.

(56) References Cited

FOREIGN PATENT DOCUMENTS

CN 109838220 A * 6/2019

OTHER PUBLICATIONS

Perkins and Gonzalez, "The Effect of Thermoelastic Stresses on Injection well Fracturing" pp. 78-88, Society of Petroleum Engineers Journal, USA, SPE 11332 (Year: 1985).*
Perkins et al. (Feb. 1, 1985) "The Effect of Thermoelastic Stresses on Injection Well Fracturing", Society of Petroleum Engineers Journal, 25(1):78-88.
Gomes, Vanessa Limeira Azevedo (2010) "Modelagem e previsao de perda de injetividade em pocos canhoneados ("Modeling and prediction of injectivity loss in perforated wells")", Master's Dissertation, UFRN, Post-graduation Program in Petroleum Science and Engineering, 101 pages.

(Continued)

*Primary Examiner* — Michael J Dalbo
*Assistant Examiner* — Kaleria Knox
(74) *Attorney, Agent, or Firm* — Morrison & Foerster LLP

(57) ABSTRACT

The present invention addresses to a method for quantifying the loss of injectivity associated with corrosion products, comprising a methodology to estimate the suspended solids generated from the corrosion process of injection strings, aiming at allowing the identification of wells with problems, definition of strategies and damage removal, as well as acting preventively and avoiding severe losses of injectivity and string degradation, consequently avoiding production losses. The developed method can be applied to any well with available injectivity history, where tests are required on representative rock samples and under controlled conditions (known water quality) for reference and application of the experimental correlation.

3 Claims, 3 Drawing Sheets

(56) References Cited

OTHER PUBLICATIONS

Moreno, Juan Manuel Montoya (2007) "Modelagem De Injecao De Dgua Acima Da Pressao De Fratura Do Reservatorio Atraves De Pogo Horizontal Virtual" ("Modeling of Water Injection Above Thereservoir Fracture Pressure Through a Virtual Horizontal Well"), Dissertation (Master's in Petroleum Science and Engineering)—Faculty of Mechanical Engineering and Institute of Geosciences—Universidade Estadual de Campinas—UNICAMP, 137 pages.

* cited by examiner

METHOD FOR QUANTIFICATION OF LOSS OF INJECTIVITY ASSOCIATED WITH CORROSION PRODUCTS

CROSS-REFERENCE TO RELATED APPLICATION

This application claims priority to Brazilian Application No. 10 2021 021656 5, filed on Oct. 28, 2021, and entitled "METHOD FOR QUANTIFICATION OF LOSS OF INJECTIVITY ASSOCIATED WITH CORROSION PRODUCTS" the disclosure of which is incorporated herein by reference in its entirety.

FIELD OF THE INVENTION

The present invention addresses to a method for quantifying the loss of injectivity associated with corrosion products with application in the field of modeling, simulation and evaluation of reservoirs, in order to allow the identification of wells with problems, definition of strategies and damage removal, as well as acting preventively and avoiding severe losses of injectivity and string degradation, consequently avoiding production losses.

DESCRIPTION OF THE STATE OF THE ART

The monitoring of injectivity is essential to guarantee the maintenance of reservoir pressure and, consequently, the production of the wells. There are several factors that can interfere with injectivity, especially the presence of particulates in the injection fluid, which can cause pores to plug, reducing the injection capacity of the well.

In most platforms, the injection of desulfated seawater (DSW) is performed, which is seawater depleted in sulfate. To remove the sulfate, the SRU (Sulphate Removal Unit) is used. In addition to modifying the chemical composition of the water, the membranes present in these units perform nanofiltration, that is, they retain particles of the order of nanometers ($10^{-9}$ meters). Thus, the effluent of this process is water of extremely high quality and practically free of solids. When this water is injected into the reservoir, losses in injection capacity are not expected, since there should be no plugging.

However, what is observed in some cases are severe losses of the injectivity of the wells, even during the exclusive injection of desulfated water. A first hypothesis would be the generation of solids between the outlet of the SRU and the injection header (point between the outlet of the SRU and the inlet to the wells). This being the scenario, these solids can be quantified on the surface. For all platforms evaluated, it was observed that the solids content in the injection header is extremely low, compatible with the premise of clean water. The conclusion, therefore, is that the generation of solids takes place between the header and the well, that is, in the injection string. One possibility is the generation of corrosion solids.

Corrosive processes can be caused by mismatching the oxygen content and/or low pH values in the injected water. In materials with less resistant metallurgy, such as carbon steel, these processes can be quite aggressive. Oxygen measurement can be difficult, especially in the absence of in-line sensors, and monitoring of corrosion rates is not always performed, which makes any estimation related to solids generation difficult.

The determination of suspended particles can be performed up to the injection header, the last sampling point on the platform, for analysis and knowledge of the quality of injected water. After this point, the water is generally considered to be unchanged. However, depending on the metallurgy and the oxygen content and pH of the water, the corrosion of the injection string may occur, which would lead to an increase in the content of suspended solids in the water, worsening its quality for injection without one being able to know/measure.

There are numerous alternatives for predicting the loss of injectivity, but without the quantification of these solids potentially generated by corrosive processes, it is difficult to understand the real extent of the problem. Thus, the strings are subject to a great process of deterioration, which can be irreversible. Even if the source of the problem is controlled (better monitoring of oxygen and pH), it is possible that the release of solids and erosive processes will still occur. In addition to the problems associated with injectivity, in a more critical scenario, it is even possible to break the string, which would lead to the need for fishing and replacement operations. By being able to quantify the problem, it is possible to determine its severity and indicate the urgency of corrective measures. Thinking about the units that will have produced water re-injection, the problem is even more serious due to the presence of oil in the re-injection water.

Thus, there is a need to quantify the extent of corrosive processes and their impacts on the generation of solids by means of a methodology based on known models, since there is an inconsistency between the water quality and the behavior of the injectivity of the wells.

In the study by LIMEIRA, V. A. G. (2010) "Modelagem e previsão de perda de injetividade em poços canhoneados" ("Modeling and prediction of injectivity loss in perforated wells"), Master's Dissertation, UFRN, Post-graduation Program in Petroleum Science and Engineering, there is presented a simulation of prediction of well injectivity loss, considering the content of suspended particles (sand, oil drops, bacteria, insoluble salts and corrosion product) and knowing all the input data, in which the impedance history adjustment for 3 wells is performed. Thus, the objective of this work is to develop a simulator for predicting the loss of injectivity, aiming at the planning of well stimulation, from the adjustment to field data and with known input data.

Document CN109838220A discloses an evaluation method for the re-injection index of water produced in an oil field, where the method comprises obtaining information on the quality of water produced in oil fields and information on the parameters of water injection at different times of re-injection, including injection pressure and injection volume.

MORENO, J. M. M. (2007) "Modelagem de injeção de água acima da pressão de fratura do reservatório através de poço horizontal virtual" ("Modeling of water injection above the reservoir fracture pressure through a virtual horizontal well"), 136 p., Dissertation (Master's in Petroleum Science and Engineering)—Faculty of Mechanical Engineering and Institute of Geosciences—Universidade Estadual de Campinas—UNICAMP, discloses an inductive coupler set for use in a bottomhole environment, and method of conducting energy and communications in a bottomhole environment. This study describes a simulation of fracture by use of a virtual horizontal well, using a commercial flow simulator and software for simulations of explicitly coupled hydraulic fracturing processes.

In view of this, no state-of-the-art document discloses the use of models in order to evaluate the injectivity to estimate the solids content generated by corrosive processes in the injection strings, where there is no possibility of performing sampling/analysis such as in the present invention.

In order to solve such problems, the present invention was developed, in which, by means of the proposed method, it performs the direct quantification of the impact of corrosive processes on injectivity, without the need to measure oxygen contents and corrosion rates. All that is needed is the injectivity history of the wells and the reference data (tests on representative rock samples and with water of known quality). In this way, it is possible to identify wells with more severe problems and propose necessary corrective actions. Knowledge of the problem enables better mitigation and correction strategies, such as acidification operations.

The present invention has advantages, since the use of the method allows identifying wells with problems, defining better strategies for mitigation and damage removal. In addition, it is possible to act preventively and avoid severe losses of injectivity and string degradation, thus avoiding production losses.

BRIEF DESCRIPTION OF THE INVENTION

The present invention addresses to a method for quantification of injectivity loss associated with corrosion products comprising a methodology to estimate the suspended solids generated from the corrosion process of injection strings. In this way, one of the already consolidated methodologies for injectivity evaluations is used, in order to estimate the solids content generated by corrosive processes in the injection strings. When it is not possible to measure corrosion rates, being able to assess the content of potentially generated solids may be an alternative to identify problems of oxygen mismatch or low pH in the injected water. Once identified, problems can be corrected before there is a significant loss of injectivity.

The developed method can be applied to any well with available injectivity history, where tests are required on representative rock samples and under controlled conditions (known water quality) for reference and application of the experimental correlation.

BRIEF DESCRIPTION OF DRAWINGS

The present invention will be described in more detail below, with reference to the attached figures which, in a schematic way and not limiting the inventive scope, represent examples of its embodiment. In the drawings, there are.

DETAILED DESCRIPTION OF THE INVENTION

Figure 1:
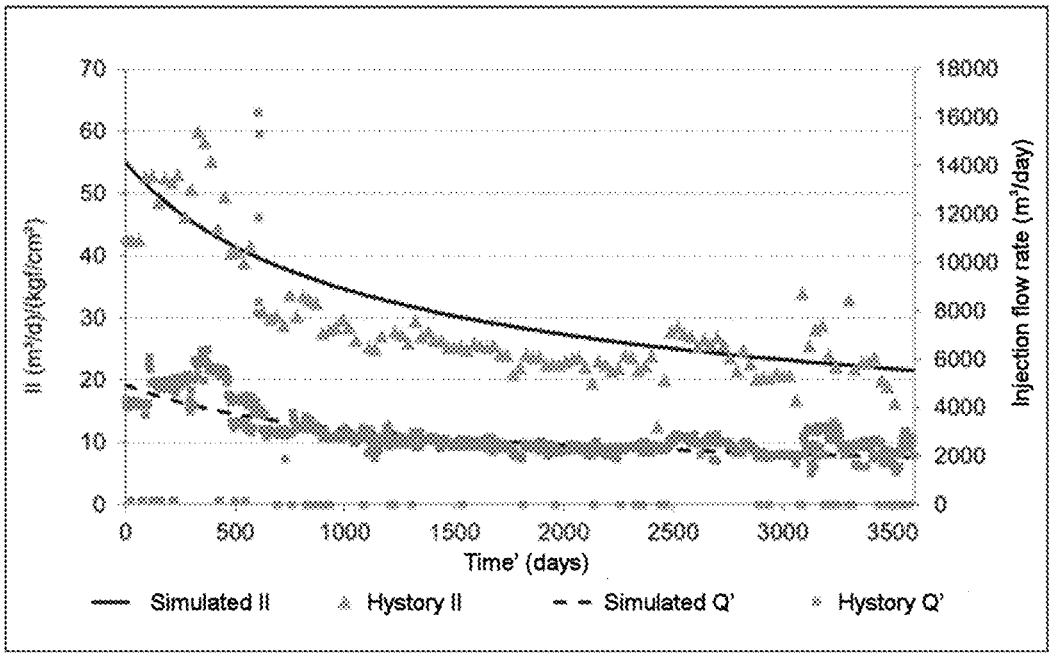
FIG. 1 illustrating an image with the history adjustment for a well injected with desulphated seawater using the Perkins & Gonzalez's model. In this modeling, the parameter pL, related to water and rock quality, is adjusted. This parameter ranges from 2 to 8, with 2 being a very poor quality and 8 being a very good one. For injection of desulfated seawater, pL values close to 8 are expected. In the figure, the adjusted value was equal to 5.1.
Figure 2:
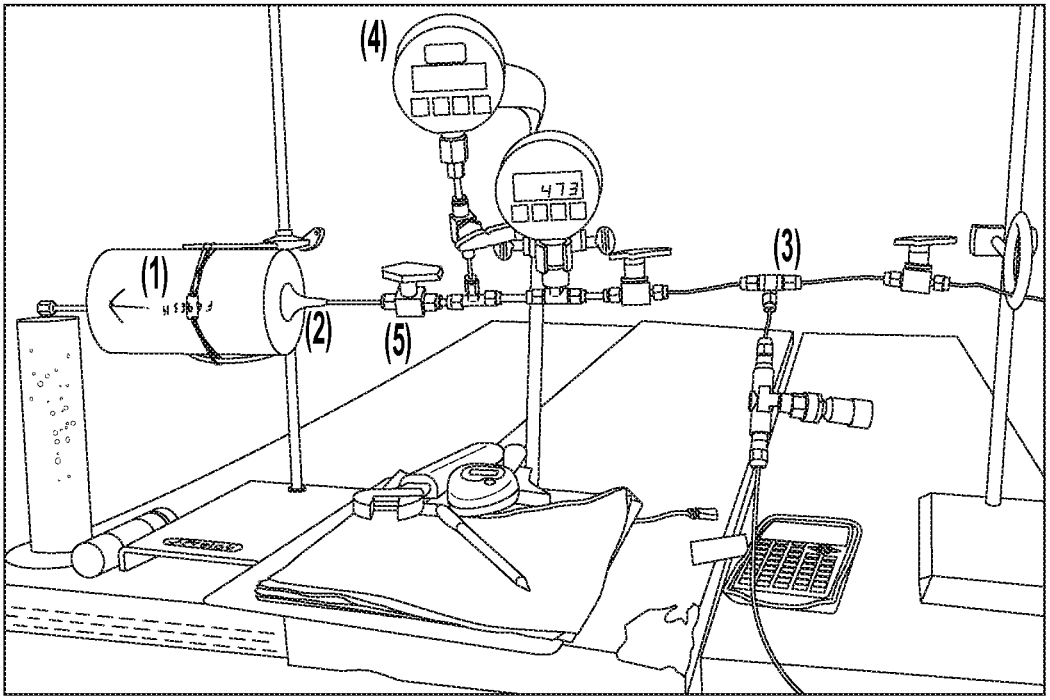
FIG. 2 illustrating a plug injectivity test performed on the platform, where the plug is connected to the water outlet of interest and flow is carried out with flow rate and pressure monitoring. This system consists of a resin rock sample on a cylindrical plastic base (1) with stainless steel terminals and diffusers (2) being mounted to allow the fluid to flow through the sample. This test resin plug is connected to the produced water sampling point at the platform plant using stainless steel connections and lines (3). Pressure gauges (4) are also used to measure the pressure at the plug inlet and valves (5) for controlling the flow rate and system safety.
Figure 3:
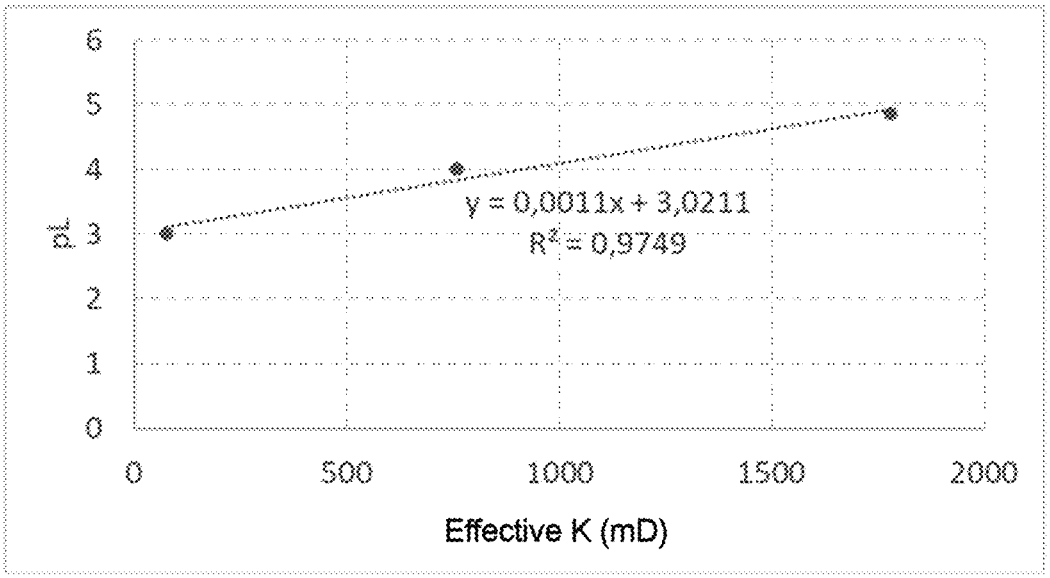
FIG. 3 illustrating the pL×permeability graph obtained from the plug tests. At least three tests are performed with samples of different permeabilities within a representative range of the reservoir. The correlation obtained refers to a water quality (content of solids and oil). For different values of suspended solids and OGC, it is possible to use an experimental correlation to determine a new pL. Plug flow tests are performed on the surface and only quantify the solids measured on the platform. They do not see string corrosion effects.

Firstly, the well injectivity history is adjusted (variation of the injectivity index over time), using the Perkins and Gonzalez modeling. For this adjustment, data from the wells are used: flow rate, bottom pressure, static pressure, fracture pressure, area open to the flow, injection temperature and estimated injectivity index). From the adjustment, the parameter "pL" of the mentioned modeling is obtained (it is the only variable in this step). This parameter is indicative of the quality of the water and the reservoir and varies between 2 (very poor) and 8 (very good). This history evaluation makes it possible to assess how the well is behaving in relation to a given water quality. On a platform, flow tests are carried out in a porous medium: a sample of rock representative of the studied well is subjected to the flow of water at some point in the process. The idea of the test is to simulate, in a reduced porous medium, what would happen in the well. The tests should preferably be carried out on the platform, so that the characteristics of the produced water are maintained. The test system consists of a resin rock sample on a cylindrical plastic base with stainless steel terminals and diffusers to allow fluid flow through the sample. The resin plug is connected to the produced water sampling point at the platform plant using stainless steel connections and lines. Pressure gauges are also used to measure the pressure at the plug inlet and valves for controlling the flow rate and system safety. During the test, flow rate and pressure are measured, so that it is possible to estimate the loss of injectivity in the sample. Water quality is measured in terms of suspended solids and oil content (if applicable). From this test, the parameter pL of the Perkins and Gonzalez modeling is also obtained, using the dimensions of the plug to calculate the area. The two pL values (history adjustment and plug) are compared using an experimental correlation. For each pL obtained, it is possible to associate a value of suspended solids content. In the case of the plug test, this value is measured on the surface, that is, all the test data are taken. For the history adjustment, this is exactly the parameter that one wants to determine, since there can be solids generation between the last point with solids measurement (injection header) and the reservoir. Thus, knowing the two data of "pL" and the water quality of the plug test, it is possible to determine, in terms of solids, the quality of the water that actually enters the reservoir. The higher the estimated solids content, the greater the problems associated with corrosion.

Therefore, the method for quantifying the loss of injectivity associated with corrosion products according to the present invention comprises the following steps:

1) Adjusting the injectivity history of the well using the Perkins and Gonzalez modeling;
2) Obtaining the parameter "pL" of said modeling, wherein this parameter is an indication of the quality of the water and the reservoir;

3) On the platform, carrying out flow tests in porous media of a rock sample representative of the studied well, wherein a system is used in which the sample is encased in resin in a cylindrical plastic base with stainless steel terminals and diffusers to allow the flow of the fluid through the sample;
4) Connecting the resin plug to the water sampling point produced in the platform plant using stainless steel connections and lines. Pressure gauges are also used to measure the pressure at the plug inlet and valves for controlling the flow rate and system safety;
5) Measuring the water quality of the platform in terms of solids and oil content (if applicable);
6) Obtaining the parameter pL from the Perkins and Gonzalez modeling from this plug flow test;
7) Comparing the two pL values (history adjustment and plug) by means of an experimental correlation;
8) For each pL obtained in the plug test, associating a solids content value measured on the platform;
9) Determining the quality of the water entering the reservoir from the pL values (history adjustment and plug) and the solids content measured on the surface in the produced water from the platform.

The developed method uses the results obtained in rock samples representative of the reservoir. In general, these samples are submitted to the flow of produced water to obtain the quality parameter of the Perkins and Gonzalez modeling. The quality of the water, i.e., the content of suspended solids and oil, is known. Still using the Perkins and Gonzalez methodology, the injectivity history of a well is adjusted, considering the injection of desulfated water. With this adjustment, it is also possible to obtain the quality parameter. By comparing the parameter obtained in the plug with the value adjusted for the well and knowing the water quality in the rock sample test, it is possible to estimate the solids in the DSW. This approach is critical, since it is not possible to measure the solids content generated between the injection header (last possible point of solids measurement) and the reservoir. When there is corrosion in the string, the content measured on the surface is not representative.

Example

The following examples are presented, in order to more fully illustrate the nature of the present invention and the manner of practicing the same, without, however, being considered as limiting its content.

The model used for the predictions of loss of injectivity is the one proposed by PERKINS, T. K. & GONZALEZ, J. A. (1985) "The effect of thermoelastic stresses on injection well fracturing", Society of Petroleum Engineers Journal, USA, SPE11332. This model considers that the pressure increase due to damage formation is given by equation 01.

$$\Delta P_s = \frac{i_w \mu_w R_s}{A_f} \tag{01}$$

Wherein:

$P_s$: pressure differential due to damage formation;
$i_w$: water injection flow rate;
$\mu_w$: water viscosity;
$R_s$: flow resistance caused by damage;
$A_f$: area in which the solids present in the injection water will be deposited, forming the damage.

The value of Rs is calculated by equation 02.

$$R_s = \frac{\lambda W_i}{A} \tag{02}$$

Wherein:

$\lambda$: water and reservoir quality factor;
$W_i$: accumulated volume of injected water;
A: area open to the flow.

The factor pL is defined as the cologarithm of $\lambda$ (equation 03) from injection water displacement tests in rock plugs that represent the reservoir or historical adjustment of the injectivity index, with its value related with the quality of water and rock. Low values (around 2) mean high injectivity losses (greater damage), whereas higher values (around 8) indicate more adequate injection conditions.

$$pL = -\log(\lambda) \tag{03}$$

The adjustment of the quality parameter "pL" of a well with DSW injection indicated a value of 4.5 (by the Perkins and Gonzalez's model and using the already mentioned well data). It is a low value for water, in theory, of excellent quality. The solids value measured on the surface (injection header) was 0.2 mg/L, considered extremely low.

A plug test, representative of the formation, showed a parameter pL=5, for a water with 5 mg/L of solids and 15 mg/L of oil. Plug and well permeabilities are compatible. The parameter pL ranges from 2 (very poor) to 8 (very good). Thus, a pL=5 (plug) indicates better behavior than a pL=4.5 (history).

Considering the data in the example, it is possible to see that the water quality associated with pL=5 is much worse than that associated with pL=4.5. The difference is the corrosion solids: they are not on the surface and therefore do not appear in the analysis (eventually, they even appear in small amounts). In the case of the plug, these solids are not present (the water that circulates in the sample is that of the surface and does not include solids generated in the injection string) and therefore the sample behavior is better. In the well, these solids must be generated in the string and end up being injected into the reservoir, but they are not quantified in the measurements. To estimate the value, the following experimental correlation can be used:

$$pL\ \text{plug} = pL\ \text{well} + \log(\text{plug solids content}/\text{DSW solids content})$$

The solids content of the plug will be a mixture of solids and oil. As the oil is deformable, only 30% of the total is considered. Thus, Plug solids content=5+0.3*15=9.5 mg/L. The DSW solids content is what one wants to find.

In the case of the example: pL plug (5)=pL well (4.5)+log (9.5/DSW solids content).

The DSW value would be 30 mg/L, much higher than that measured on the surface (0.2 mg/L).

It should be noted that, although the present invention has been described in relation to the attached drawings, it may undergo modifications and adaptations by technicians skilled on the subject, depending on the specific situation, but provided that it is within the inventive scope defined herein.

The invention claimed is:

1. A method for quantification of loss of injectivity associated with corrosion products, wherein the method comprises:

Adjusting an injectivity history of a well using Perkins and Gonzalez modeling;

Obtaining a first parameter of said modeling, where the first parameter is an indication of water and reservoir quality;

On a platform, carrying out flow tests in porous media of a rock sample representative of the well, wherein a system is used in which the sample is encased in resin in a cylindrical plastic base with stainless steel terminals and diffusers to allow flow of a fluid through the sample;

Connecting a resin plug to a water sampling point produced in the platform from stainless steel connections and lines, wherein pressure gauges are used to measure pressure at a plug inlet and valves are used for controlling flow rate and system safety;

Measuring water quality of the platform in terms of solids and oil content;

Obtaining a second parameter from the Perkins and Gonzalez modeling from the plug flow test;

Comparing the first and second parameters by an experimental correlation;

For the second parameter obtained in the plug flow test, associating a solids content value measured on the platform;

Determining the quality of the water entering the reservoir from the first and second parameters and the solids content measured on the surface in the produced water from the platform.

2. The method according to claim 1, wherein the historical adjustment uses the following well data: flow rate, bottom pressure, static pressure, fracture pressure, area open to the flow, injection temperature, and estimated injectivity index.

3. The method according to claim 1, wherein the first and second parameters vary between 2 and 8.

* * * * *